US005396212A

United States Patent [19]

Hernandez et al.

[11] Patent Number: 5,396,212

[45] Date of Patent: Mar. 7, 1995

[54] TRANSFORMER WINDING

[75] Inventors: Augusto D. Hernandez, Waukesha, Wis.; Gary D. King, Nacogdoches, Tex.; Craig J. De Rouen, Nacogdoches, Tex.; Kenneth R. Beck, Nacogdoches, Tex.

[73] Assignee: Cooper Industries, Inc., Houston, Tex.

[21] Appl. No.: 874,164

[22] Filed: Apr. 27, 1992

[51] Int. Cl.[6] ..... H01F 27/28

[52] U.S. Cl. ..... 336/223

[58] Field of Search ..... 336/223

[56] References Cited

U.S. PATENT DOCUMENTS

| | | | |
|---|---|---|---|
| 452,003 | 5/1891 | Lipe | 336/223 X |
| 525,800 | 9/1894 | Sanders | 336/223 X |
| 1,041,293 | 10/1912 | Keller | 336/223 X |
| 1,825,105 | 9/1931 | Terman | 336/223 X |
| 1,935,404 | 11/1933 | Leopold | 336/223 X |
| 2,092,058 | 9/1937 | Ferris | 336/223 X |
| 2,286,759 | 6/1942 | Patrode | 336/223 X |
| 2,783,399 | 2/1957 | Fenemore | 336/223 X |
| 2,949,592 | 8/1960 | Smiley | 336/223 X |
| 3,348,183 | 10/1967 | Hodges et al. | 336/223 |
| 3,501,728 | 3/1970 | Barriball | 336/223 X |
| 3,558,803 | 8/1970 | Osborn | 336/223 X |
| 3,697,914 | 10/1972 | Khrenov et al. | 336/223 X |
| 4,398,467 | 8/1983 | Leigh | 102/491 |
| 4,543,808 | 10/1985 | Nilsson et al. | 72/137 |
| 4,631,509 | 12/1986 | Arii et al. | 336/92 |
| 4,665,952 | 5/1987 | Macemon et al. | 140/92.2 |
| 4,673,907 | 6/1987 | Lee | 336/92 |
| 4,683,919 | 8/1987 | Macemon et al. | 140/92.2 |
| 4,699,184 | 10/1987 | Macemon et al. | 140/92.2 |
| 4,741,484 | 5/1988 | Curtis, Jr. et al. | 242/703 |
| 4,814,733 | 3/1989 | Menge | 336/69 |
| 4,858,644 | 8/1989 | Decker | 137/504 |
| 4,870,742 | 10/1989 | Roloff | 29/335 |
| 4,896,839 | 1/1990 | Curtis, Jr. et al. | 242/7.02 |
| 4,944,524 | 7/1990 | Achenbach | 280/701 |
| 5,032,816 | 7/1991 | Lenzing et al. | 336/223 X |
| 5,074,140 | 12/1991 | Sanders | 72/248 |

FOREIGN PATENT DOCUMENTS

| | | | |
|---|---|---|---|
| 409011 | 1/1945 | Italy | 336/223 |
| 758107 | 9/1956 | United Kingdom | 336/223 |

OTHER PUBLICATIONS

McGraw-Hill Encyclopedia of Engineering (1983), pp. 1115-1120.

Memorandum from W. Delfosse, dated Aug. 31, 1982.

*Primary Examiner*—Leo P. Picard
*Assistant Examiner*—L. Thomas
*Attorney, Agent, or Firm*—Kenyon & Kenyon

[57] ABSTRACT

A transformer conductor is shaped so as to compensate for the deformation that occurs when the conductor is bent through a small radius of curvature. The shape in cross-section of the conductor may take the form of a chamfered rectangle.

8 Claims, 2 Drawing Sheets

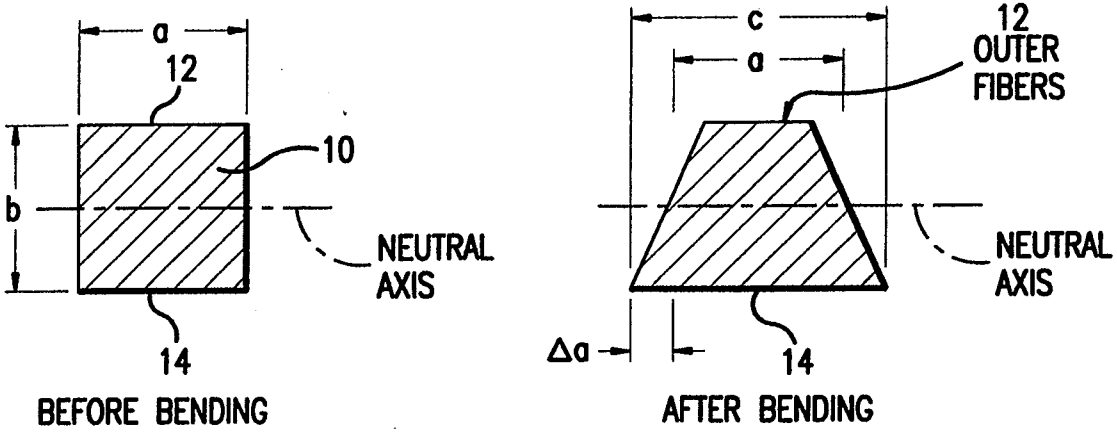
BEFORE BENDING
FIG.1A
(PRIOR ART)
AFTER BENDING
FIG.1B
(PRIOR ART)
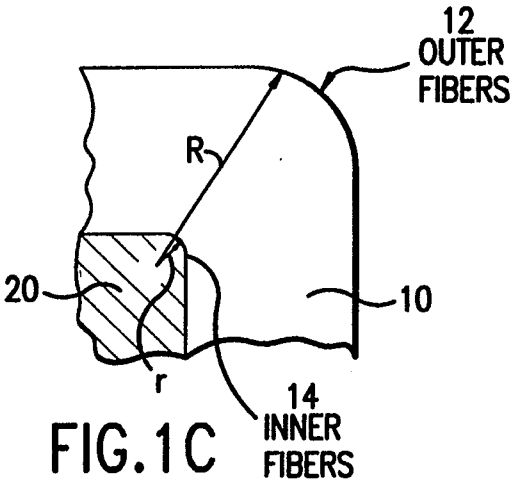
FIG.1C
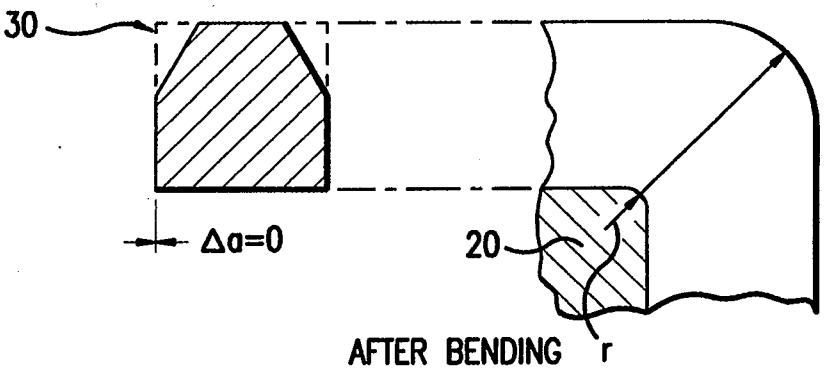
AFTER BENDING
FIG.3
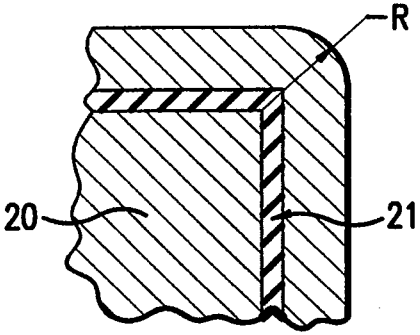
FIG.1D

TRANSFORMER WINDING

TECHNICAL FIELD

The present invention relates to coil windings generally, and more particularly to a transformer winding that is both space efficient and that retains its dielectric reliability.

BACKGROUND OF THE INVENTION

Electrical transformers are generally constructed of two coils of conductor (generally known as the primary and secondary windings or coils) wound about a core. The core is often constructed of a series of stacked thin steel plates which are wrapped in an insulating material. The individual windings about the core are also insulated so as to prevent an electrical short between adjacent windings or layers. (The conventional aspects of transformer design are set forth in the McGraw-Hill Encyclopedia of Engineering (1983) at pages 1115–1120, the disclosure of which is hereby incorporated by reference.)

The presence of excessive voids and gaps between and among the layers and windings of conductor constitute regions of vulnerability at which the electromagnetic forces typically generated within a transformer can cause damage. Spatial limitations also often impose constraints upon transformer design. Therefore, it is often important that the transformer be as compact and space efficient as possible. This has led designers to utilize cores of rectangular cross-section about which are wound conductor having a square or rectangular cross-section The use of rectangular conductors about a rectangular core is space efficient. However, it presents problems of its own. When a rectangular conductor is bent 90 degrees through a sharp turn about one of the corners of the core, it undergoes deformation in the region of the bend. When a rectangular conductor is bent about a small radius (which is the case for the conductor wound immediately adjacent the core), the longitudinally oriented portions of the conductor that lie nearer the center of curvature become shorter. Concomitantly, the longitudinally oriented portions of the conductor that are farther removed from the center of curvature become elongated. The area where the two portions meet undergoes neither elongation nor foreshortening along the longitudinal axis of the conductor (in cross-section, this is the neutral axis). Because the overall volume of the conductor remains generally constant, changes in the dimension of the conductor in the longitudinal direction have countervailing effects in the cross-sectional shape of the conductor. At the inner radius, the conductor is placed in compression and a compressive strain in the axial direction of the conductor occurs. The axial strain is known to occur along with a lateral strain. Within the elastic limit of the material, these strains are proportional to each other (the well-known Poisson's ratio). As the material is bent further, the stresses exceed the elastic limit and the material acquires a permanent deformation. Where the longitudinal fibers have elongated (the outer portion), the cross-sections constrict and become smaller; where the axial fibers have shortened (the inner portion), the cross-section expands and becomes larger (the "mushroom" effect). The overall effect in this plastic regime is that the conductor shape that was originally rectangular in cross-section appears to "mushroom out" at the side nearer the core and the conductor acquires the shape of a trapezoid at the bend. The result of this process is illustrated in FIG. 1—the rectangular cross-section has become a trapezoid. Unless accounted for, this trapezoidal distortion may cause interference with the conductor immediately adjacent it in the coil. This mushrooming effect can result in the dielectric failure of the insulation about the conductor as the wider base of the trapezoid pinches through the insulation wrapped about it or about an adjacent turn of the conductor.

In the prior art, this effect has been accommodated for by allowing increased spacing between conductor windings, thereby reducing the compactness of the coil. There remains a need for a conductor winding which is both space efficient and which more reliably maintains the dielectric integrity of the coil.

SUMMARY OF THE INVENTION

The present invention is directed toward a transformer winding that avoids the problems and disadvantages of the prior art through the provision of a conductor whose cross-section has been modified prior to winding so as to compensate for the expected strains of winding the conductor about a rectangular core. The initial conductor cross-sectional shape may be in the form of an inverted trapezoid or a chamfered rectangle. Other shapes, such as a rectangle having two rounded corners, may be utilized. The shape is selected so that after bending, the portion of the conductor lying nearer the winding core assumes a shape that does not extend beyond the hypothetical spatial envelope of the equivalent rectangular conductor.

BRIEF DESCRIPTION OF THE DRAWINGS

FIG. 1A illustrates in cross-section a prior art conductor prior to bending;

FIG. 1B shows the same cross-section after the prior art conductor has been bent about a corner of a rectangular core;

FIG. 1C shows the relationship between the inner and outer fibers of the conductor in the region of the bend;

FIG. 1D illustrates in cross-section a portion of a transformer core and winding;

FIG. 3 illustrates one possible shape of a conductor after bending.

DETAILED DESCRIPTION

Figure 2A:
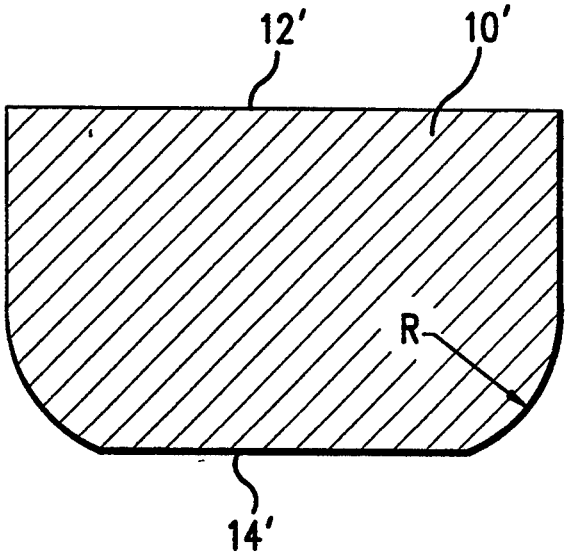
FIGS. 2A, 2B, and 2C illustrate in cross-section three possible corrective conductor shapes before bending.

FIG. 1A illustrates in cross-section and before bending a rectangular conductor 10 of the sort that has been employed in the prior art. In cross-section the conductor has a height b and a width a. The effect of bending a conductor having a rectangular cross-section is illustrated in FIG. 1B. The portion below the neutral axis (this is the portion nearer the conductor) has undergone expansion with respect to its original lateral dimensions by an amount $\Delta a$ on each side. This expansion is at a maximum along side 14, which cuts across the inner fibers nearest the center of bending. A corresponding lateral contraction occurs above the neutral axis, and becomes most pronounced at the outermost fibers 12. FIG. 1C shows the relationship between the outer fibers, the inner fibers, and the transformer core 20. FIG. 1D further illustrates in cross-section the transformer core 20 and a winding. The core illustrated is formed of a stack of plates, here surrounded by a layer of insulation 21.

The present invention avoids the lateral mushrooming of the conductor below the neutral axis beyond the sides of an imaginary rectangle. This rectangle's lateral dimension is sized to produce a maximum degree of winding compactness without harmful winding to winding interference. To accomplish this, material is removed from along the length of the conductor by an amount which compensates for the mushrooming associated with the deformation of the conductor.

Figure 2B:
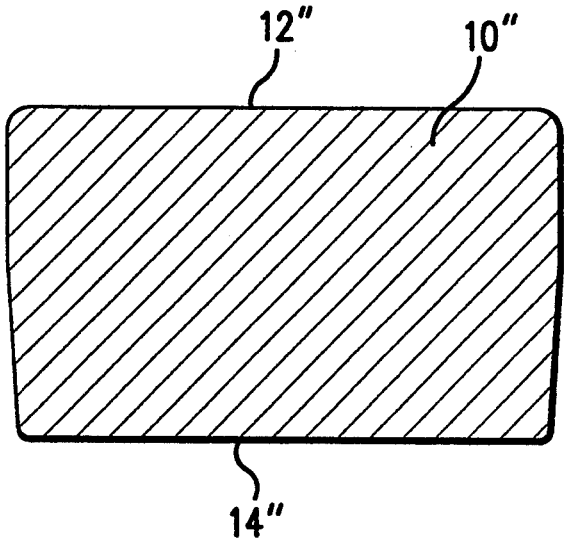
Figure 2C:
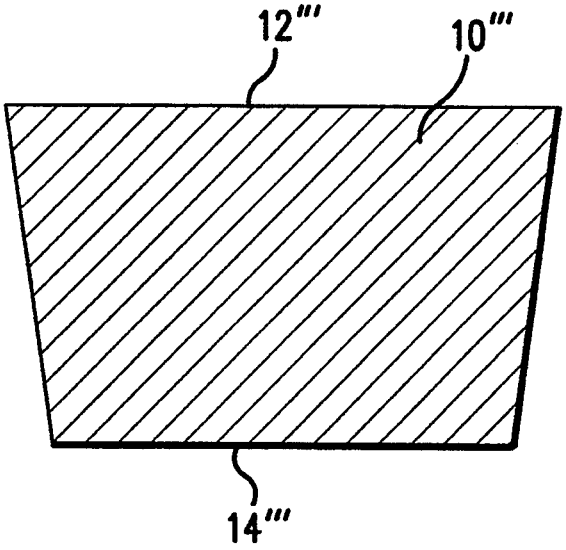

FIGS. 2A, 2B and 2C illustrate three possible compensatory cross-sections. In FIG. 2A for example, the lower half of the wire is given a more rounded shape at two adjacent corners. In FIG. 2B, the lower half of the conductor has been chamfered to form a trapezoid. In FIG. 2C, the cross-section is in the shape of a trapezoid. In each case the deformation of the conductor will cause the lower half to balloon out to a more rectangular configuration. (The contraction of the upper half need not be corrected for since it does not cause interference and thus does not present a threat to the dielectric integrity of the windings.) The particular dimensions employed will, of course, depend on the size of the transformer winding as well as the material (for example aluminum or copper) that is employed. The above method may be practiced on either a secondary or a primary winding and on any type of transformer or winding in which spatial considerations are important.

The material may be removed through conventional milling or rolling techniques applied to conductor having a rectangular cross-section, or conductor may be extruded through a die already having the desired cross-section. The particular forming technique employed is somewhat dependent upon the material used to form the conductor. Copper conductor, generally speaking, is formed with a rolling process, whereas aluminum conductor may be rolled or extruded. These and other suitable techniques for forming conductor of the desired shape are well known in the art.

FIG. 3 illustrates the effect of bending on such a compensatory shape. The cross-sections of the bent portion do not extend beyond the envelope 30 that a hypothetical rectangular conductor undergoing no lateral strain during bending would define. Portions of the outer surfaces of the conductor may well fall short of and lie within the boundary of this envelope, but they do not extend beyond it to cause interference problems.

What is claimed is:

1. A method of compactly winding conductor about a core having a rectangular cross-section, comprising the steps of:

providing a conductor with a cross-sectional shape having an first, rectangular portion and a second, trapezoidal portion contiguous with the first rectangular portion and being oriented so as to lie nearer the core than the first, rectangular portion; and bending the conductor about the right-angle edges of the core so that as the conductor is wound about the core, the trapezoidal portion of the conductor nearer the core expands laterally outwardly and the rectangular portion of the cross section of the conductor laterally contracts in the region of the core edges.

2. The method of claim 1, wherein the conductor is shaped by extrusion through a die.

3. The method of claim 1, wherein the conductor is is formed through a rolling process.

4. The method of claim 1, wherein the conductor is made of aluminum.

5. The method of claim 1, wherein the conductor is made of copper.

6. A winding, comprising:

a generally rectangular core having four longitudinally extending edges; and a length of conductor, said conductor being wound about the core and having a compound cross-sectional shape in the portion of the winding that is between the edges of the core having a first, generally rectangular portion away from the core and a second, trapezoidally-shaped portion closer to the core.

7. The winding of claim 6, wherein the conductor is made of aluminum.

8. The winding of claim 6, wherein the conductor is made of copper.

* * * * *